US007467633B2

(12) United States Patent
Smith et al.

(10) Patent No.: US 7,467,633 B2
(45) Date of Patent: Dec. 23, 2008

(54) ENHANCED SOLUBILIZATION USING EXTENDED CHAIN SURFACTANTS

(75) Inventors: George A. Smith, The Woodlands, TX (US); Katie R. Hand, Spring, TX (US)

(73) Assignee: Huntsman Petrochemical Corporation, The Woodlands, TX (US)

( * ) Notice: Subject to any disclaimer, the term of this patent is extended or adjusted under 35 U.S.C. 154(b) by 0 days.

(21) Appl. No.: 11/372,501

(22) Filed: Mar. 10, 2006

(65) Prior Publication Data

US 2006/0211593 A1 Sep. 21, 2006

Related U.S. Application Data

(60) Provisional application No. 60/660,285, filed on Mar. 10, 2005.

(51) Int. Cl.

| | |
|---|---|
| ***B08B 3/04*** | (2006.01) |
| ***C11D 1/29*** | (2006.01) |
| ***C11D 1/66*** | (2006.01) |
| ***C11D 1/83*** | (2006.01) |

(52) U.S. Cl. ..... 134/25.2; 134/25.3; 134/25.4; 134/39; 134/40; 134/42; 510/127; 510/155; 510/340; 510/351; 510/357; 510/360; 510/421; 510/426; 510/495; 510/505; 510/535

(58) Field of Classification Search ..... 510/127, 510/155, 340, 351, 357, 360, 421, 426, 495, 510/505, 535; 134/25.2, 25.3, 25.4, 39, 40, 134/42

See application file for complete search history.

(56) References Cited

U.S. PATENT DOCUMENTS

| | | | | |
|---|---|---|---|---|
| 4,608,197 | A * | 8/1986 | Kesling et al. | 510/537 |
| 5,411,674 | A * | 5/1995 | Tagata et al. | 510/424 |
| 6,034,049 | A | 3/2000 | Erilli et al. | |
| 6,037,317 | A | 3/2000 | Rapisarda et al. | |
| 6,191,090 | B1 | 2/2001 | Mondin et al. | |
| 6,407,051 | B1 | 6/2002 | Smith et al. | |
| 6,608,020 | B1 | 8/2003 | Durbut et al. | |
| 6,701,940 | B2 | 3/2004 | Tsibouklis et al. | |
| 6,720,298 | B2 | 4/2004 | Blything et al. | |
| 6,730,131 | B2 | 5/2004 | Behler et al. | |
| 6,794,349 | B2 | 9/2004 | Hafkamp et al. | |
| 6,821,937 | B2 | 11/2004 | Gross | |
| 6,844,309 | B1 | 1/2005 | Sivik et al. | |

OTHER PUBLICATIONS

M. Miñana-Perez et al; "Systems containing Mixtures of Extended Surfactants & Conventional Nonionics. Phase Behavior and Solubilization in Microemulsion", no date given.

Proceedings of the CESIO 4th World Surfactant Congress, Barcelona vol. 1, 223-234 (1996), no month given.

George Smith, Promod Kumar, Duy Nguyen, "Formulating Cleaning Products with Microemulsions", Huntsman Corporation, Austin, TX US, no date given.

* cited by examiner

*Primary Examiner*—Brian P Mruk

(74) *Attorney, Agent, or Firm*—Ron D. Brown; Robert Holthus; Rhonda L. Sheldon

(57) ABSTRACT

The present invention provides a surfactant blend that includes an extended chain surfactant and high HLB nonionic surfactant. The surfactant blend may be incorporated into household and industrial-institutional cleaning products to solubilize hard to remove oily stains and soil from a variety of surfaces.

15 Claims, 7 Drawing Sheets

ENHANCED SOLUBILIZATION USING EXTENDED CHAIN SURFACTANTS

CROSS-REFERENCE TO RELATED APPLICATION

This application claims priority to provisional application U.S. Pat. App. 60/660,285 filed on Mar. 10, 2005.

STATEMENT REGARDING FEDERALLY SPONSORED RESEARCH OR DEVELOPMENT

Not Applicable.

FIELD OF THE INVENTION

The present invention is directed to a surfactant blend containing an extended chain surfactant and a high HLB nonionic surfactant and its application in household and industrial-institutional cleaning products.

BACKGROUND OF THE INVENTION

Numerous studies have been performed to determine the phase behavior of surfactant-oil-water systems. Results from these studies have shown that mixtures of water and oil separate within a well-defined temperature interval into three liquid phases (an aqueous phase, an oil phase, and a surfactant rich phase) with the maximum mutual solubility between water and oil and the lowest inter-facial tension being found in the surfactant rich phase. Numerous attempts to improve oil solubilization in these systems have been tried, such as using a surfactant with both a larger hydrophilic group and larger hydrocarbon tail, and the use of an additive lipophilic linker. More recently, Salager et al. (Proceeding of the CESIO $4^{th}$ World Surfactant Congress, Barcelona, Vol. 1, 223-234 (1996)) has shown oil solubilization may be improved in these ternary systems through the use of an extended chain surfactant.

In household and industrial-institutional cleaning products, the surfactants used are generally composed of a lipophilic group attached to a hydrophilic group. In aqueous solution, the surfactant molecules associate to form micelles which can solubilize soils or stains present on an article. Where cleaning product clarity and homogeneity are important considerations, the surfactant is incorporated into an oil-in-water microemulsion. These cleaning products contain a variety of different sufactant systems in 5-20% solubilized oil which are then diluted with water prior to use. The surfactant systems generally employed in these cleaning products include a mixture of anionic or non-ionic surfactants and a short chain alcohol to help solubilize the oil phase and prevent liquid crystal formation. While short chain alcohols are effective, they contribute to the volatile organic solvent content (VOC) of the product and pose flammability problems. Thus, it would be desirable to produce a VOC-free surfactant system, capable of forming a single phase microemulsion with a variety of different oils, which can be incorporated into cleaning products to enhance cleaning performance.

SUMMARY OF THE INVENTION

The present invention provides a surfactant blend comprising an extended chain surfactant and a high HLB nonionic surfactant. The surfactant blend can be incorporated into a single phase microemulsion and delivered as a cleaning composition for use in a variety of settings such as metal cleaning, circuit board defluxing, automotive cleaning, paint stripping, laundry pretreaters, laundry detergents, skin cleansers, and hair cleaning and conditioning formulations. The surfactant blend can also be delivered directly to a soiled surface to solubilize and remove the soil from the surface. The surfactant blend of the present invention is particularly effective for removing grease and oil substances, such as high molecular weight motor oils and triglycerides, which are difficult to solubilize.

BRIEF DESCRIPTION OF FIGURES

For a detailed understanding and better appreciation of the present invention, reference should be made to the following detailed description of the invention, taken in conjunction with the accompanying figure.

DETAILED DESCRIPTION OF THE INVENTION

Figure 1:
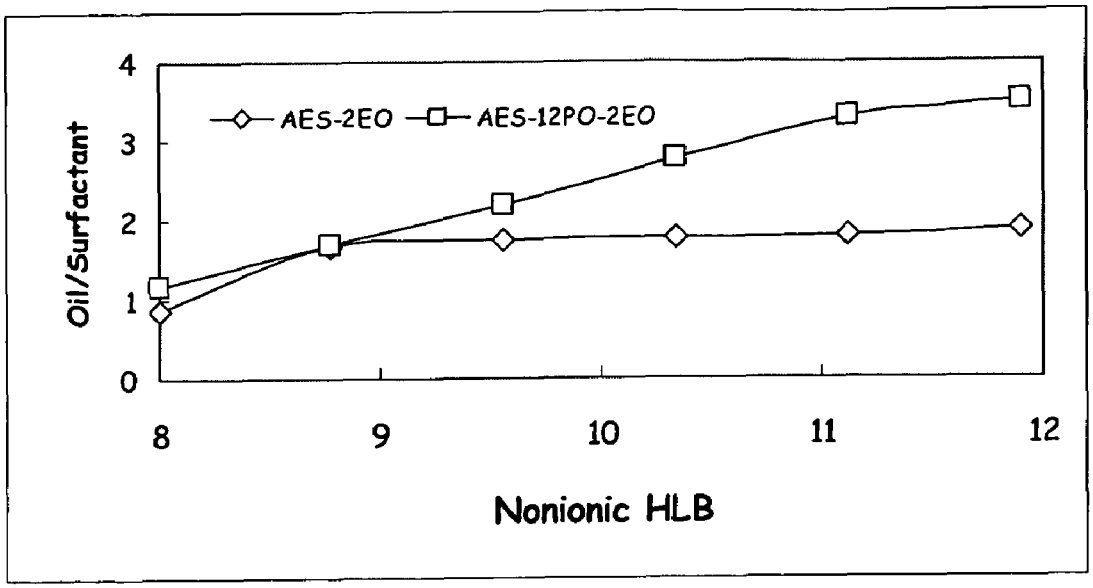
FIG. 1 is a graph describing the solubilization efficiency of surfactant blends containing a nonionic surfactant and either a conventional ether sulfate or an extended chain ether sulfate for a 50/50 wt. % solution of pine oil and water.

The present invention relates to surfactant blends containing an extended chain surfactant and a conventional high HLB nonionic surfactant. It has been surprisingly found that combining these two components produces a surfactant blend which may be used in household and industrial-institutional cleaning compositions to enhance soil and stain removal performance. By "enhanced" it is to be understood that an increased interaction occurs between the soil and surfactant blend according to the present invention as compared to the interaction between soil and a surfactant blend comprising either only one of the components or none of them.

The term "surfactant" as used herein is a compound that contains a lipophilic segment and a hydrophilic segment, which when added to water or solvents, reduces the surface tension of the system.

An "extended chain surfactant" is a surfactant having an intermediate polarity linking chain, such as a block of polypropylene oxide, inserted between the surfactant's conventional lipophilic segment and hydrophilic segment.

The term "hydrophilic/lipophilic balance index" or "HLB" is a numerical index for a given surfactant structure, indicating its balance of hydrophilic and lipophilic properties. A surfactant with a high HLB is more hydrophilic and less lipophilic in character than a surfactant with a low HLB.

The term "electrolyte" refers to a substance that will provide ionic conductivity when dissolved in water or when in contact with it; such compounds may either be solid or liquid.

As used herein, the term "microemulsion" refers to thermodynamically stable, isotropic dispersions consisting of nanometer size domains of water and/or oil stabilized by an interfacial film of surface active agent characterized by ultra low interfacial tension.

The term "hard surface" refers to a solid, substantially non-flexible surface such as a counter top, tile, floor, wall, panel, window, plumbing fixture, kitchen and bathroom furniture, appliance, engine, circuit board, and dish.

The term "soft surface" refers to a softer, highly flexible material such as fabric, carpet, hair, and skin.

"Soil" or "stain" refers to a non-polar oily substance which may or may not contain particulate matter such as mineral clays, sand, natural mineral matter, carbon black, graphite, kaolin, environmental dust, etc.

Surfactant Blend

As a first essential component, the surfactant blends of the present invention include one or more extended chain surfactants. In one embodiment, the extended chain surfactants suitable for use are compounds of the general formula (1):

$$R\text{-}[L]_x\text{-}[O\text{—}CH_2\text{—}CH_2]_y\text{—}O\text{—}SO_3A \quad (I)$$

where R is a linear or branched, saturated or unsaturated, substituted or unsubstituted, aliphatic or aromatic hydrocarbon radical having from about 8 to 20 carbon atoms; L is a linking group, such as a block of poly-propylene oxide, or a block of poly-ethylene oxide, or a block of poly-butylene oxide or a mixture thereof; A is any cationic species present for charge neutrality such as hydrogen, an alkali metal, alkaline earth metal, ammonium and ammonium ions which may be substituted with one or more organic groups; x is the chain length of the linking group ranging from 5-15; and y is the average degree of ethoxylation ranging from 1-5.

In another embodiment, the extended chain surfactant has a general formula (II):

$$R\text{—}\left(O\text{—}CH_2\text{—}\underset{}{\overset{CH_3}{\overset{|}{CH}}}\right)_x\left(O\text{—}CH_2\text{—}CH_2\right)_y\text{—}O\text{—}SO_3Na \quad (II)$$

where R is a linear or branched, saturated or unsaturated, substituted or unsubstituted aliphatic hydrocarbon radical having from about 8 to 20 carbon atoms; x is the average degree of propoxylation ranging from 5-15; and y is the average degree of ethoxylation ranging from 1-5.

The extended chain surfactants of formula (II) may be derived by, for example, by the propoxylation, ethoxylation and sulfation of an appropriate alcohol, such as Ziegler, Oxo or natural alcohol of varying chain length and alkyl chain distributions ranging from about 8 to 20 carbon atoms. Examples of appropriate alcohols include commercially available alcohols such as ALFOL® (Vista Chem. Co.), SAFOL® (Sasol Ltd.), NEODOL® (Shell), LOROL® (Henkel), etc.

Suitable chemical processes for preparing the extended chain surfactants of formula (II) include the reaction of the appropriate alcohol with propylene oxide and ethylene oxide in the presence of a base catalyst, such as sodium hydroxide, potassium hydroxide or sodium methoxide, to produce an alkoxylated alcohol. The alkoxylated alcohol may then be reacted with chlorosulfonic acid or $SO_3$ and neutralized to produce the extended chain surfactant.

As a second essential component, the surfactant blends of the present invention also include a high HLB nonionic surfactant. As used herein, a high HLB nonionic surfactant relates to one nonionic surfactant having an HLB ranging from about 5 to about 20, preferably from about 7 to about 14, or a mixture of two or more nonionic surfactants having a weighted mean HLB in accordance the above values. Such nonionic surfactants are well known to those of ordinary skill in the art and include alkoxylated $C_{8-20}$ alcohols and alkyl phenols. The alkoxylated alcohols may be ethoxylated alcohols, propoxylated alcohols and/or a mixture of ethoxylated/propoxylated alcohols. Surfactants catalogs are available which list a number of these conventional nonionic surfactants, together with their respective HLB values, which may be used when choosing the high HLB nonionic sufactant.

Suitable chemical processes for preparing the high HLB nonionic surfactants for use herein include condensation of corresponding straight or branched chain alcohols with alkylene oxide in the desired proportions. Thus, an alcohol is used as an initiator molecule and an alkylene oxide or a mixture of alkylene oxides is polymerized onto the initiator molecule to form a first block. Thereafter, a second alkylene oxide or mixture of alkylene oxides can optionally be added to form a second block. Third and subsequent blocks can also be added. Alternatively, a great variety of alkoxylated alcohols suitable for use as high HLB nonionic surfactants are commercially available from various suppliers.

Preferred for use herein are polyethylene oxide ethers derived from lauryl alcohol, cetyl alcohol, oleyl alcohol, stearyl alcohol, isostearyl alcohol, myristyl alcohol, behenyl alcohol, and mixtures thereof. In addition, polyoxyethylene 10 cetyl ether, known by the CTFA designation as ceteth-10; polyoxyethylene(21)stearyl ether, known by the CTFA designation steareth-21; coconut alkyl polyethoxylate(6.5); decyl polyethoxylate(6); and mixtures thereof may also be used. The high HLB nonionic surfactants of the present invention do not include ethoxylates of nonylphenol, dinonylphenol, dodecylphenol, dodecyl alcohol or sorbitan lauryl esters ethoxylated with 20 EO groups.

Examples of commercial high HLB nonionic surfactants that may be used include one or a mixture of any of the following: SURFONIC® L12-6, SURFONIC® L12-8, SURFONIC® L24-2, SURFONIC® L24-3, SURFONIC® L24-4, SURFONIC® L24-5, SURFONIC® L24-7, SURFONIC® L24-9, SURFONIC® L24-12,SURFONIC® L24-22, SURFONIC® LSF 23-9 and SURFONIC® L46-7 from Huntsman Corporation. Other examples include TERGITOL® 15S9 (The Dow Chemical Company), and NEODOL® 91-8 NEODOL® 23-9, NEODOL® 45-9 (Shell Chemicals). Other commercial sources of such surfactants can be found in McCutcheon's EMULSIFIERS AND DETERGENTS, North American Edition, 2000, McCutcheon Division, MC Publishing Company, which is incorporated herein by reference.

The extended chain surfactant and high HLB nonionic surfactant are combined as a surfactant blend at a weight ratio which is sufficient to provide a single phase microemulsion when combined with water and water insoluble solvent or oil. Preferably, the weight ratio of extended chain surfactant to high HLB nonionic surfactant ranges between about 1:10 to 10:1, preferably from about 1:4 to 4:1, more preferably from about 1:3 to 3:1, and even more preferably from about 1:2 to 2:1.

The surfactant blend may also contain one or more optional ingredients. One such optional ingredient is a hydrotrope to prevent liquid crystal formation. The addition of the hydrotrope thus reduces the viscosity of the microemulsion and aids the clarity/transparency of the surfactant blend. Suitable hydrotropes include but are not limited to propylene glycol, glycol ethers, ethanol, urea, salts of benzene sulphonate, toluene sulphonate, xylene sulphonate or cumene sulphonate. Suitable salts include but are not limited to sodium, potassium, and ammonium. Preferably, the hydrotrope is selected from the group consisting of propylene glycol, xylene sulfonate, ethanol, and urea to provide optimum performance. When present, the amount of the hydrotrope is generally in the range of from about 0.5 to 40% by weight of the total surfactant blend.

The sufactant blend may also contain one or more electrolytes. Examples of electrolytes which may be added include sulfuric acid or metal salts such as NaCl or KCl. When present the electrolyte or electrolytes are generally in the range of from about 1-20% by weight of the total surfactant blend, preferably from about 3-15% by weight, and more preferably from about 4-12% by weight of the total surfactant blend.

The surfactant blend may also contain additional surfactants, herein referred to as co-surfactants, selected from anionic surfactants, cationic surfactants, amphoteric surfactants and zwitterionic surfactants.

The anionic surfactants are preferably carboxylic acid salts, alkyl benzene sulfonates, secondary n-alkane sulfonates, alpha-olefin sulfonates, dialkyl diphenylene oxide sulfonates, sulfosuccinate esters, isoethionates, linear alcohol sulfates, linear alcohol ethoxy sulfates, phosphate esters of alcohols and alkoxylated alcohols and mixtures thereof. When present, the amount of the anionic surfactant is generally in the range of from about 1-40% by weight of the total surfactant blend.

Cationic surfactants include, for example, primary amine salts, diamine salts, quaternary ammonium salts, ethoxylated amines and mixtures thereof. When present, the amount of the cationic surfactant is generally in the range of from about 0.5-5% by weight of the total surfactant blend.

Amphoteric and zwitterionic surfactants are generally selected from alkylbetaines, amine oxides, polycarboxylates, alkyl aminopropionic acids, alkyl iminopropionic acids, imidazoline carboxylates, sulfobetaines, and sultaines. When present, the amount of the amphoteric or zwitterionic surfactant is generally in the range of from about 1-40% by weight of the total surfactant blend.

It has been surprisingly found that the surfactant blend of the present invention has the ability to enhance the solubility of long chain oils, such as hydrocarbon oils, synthetic triglyceride oils, and natural triglyceride oils. That is, the solubility achieved by using an extended chain surfactant in combination with a high HLB nonionic surfactant is improved as compared to the solubility obtained with using either only one of these components or none of them. Thus, the surfactant blend can be used to provide enhanced cleaning performance by forming a single phase microemulsion of a soil or stain on a surface. The single phase microemulsion according to the present invention is preferably clear and exhibits stability over a broad range of temperature, for example, from about 2° C. up to about 50° C.

In one embodiment, the surfactant blend is provided as a cleaning composition which can be applied directly to a soiled soft or hard surface. Upon contact, a single phase microemulsion is formed on the surface allowing the oily or greasy substance to become solubilized and removed from the surface.

In another embodiment, the surfactant blend is provided in the form of a single phase microemulsion, for example, a concentrated cleaning composition, which can be diluted with water by the user to form a ready to use cleaning composition. The concentrated cleaning composition generally includes between about 5 wt. % and about 50 wt. % of the surfactant blend and between about 50 wt. % and 90 wt. % of water. Accordingly, the cleaning composition may also be provided to the user as a ready to use cleaning composition in which the concentrated cleaning composition has already been diluted with up to about 95-99 wt. % water.

In addition to the surfactant blend and water, the concentrated or ready to use cleaning composition also includes one or more water insoluble solvents or oils or mixtures thereof herein referred to as an oil component. The oil component helps form the single phase microemulsion and at the same time, acts as a solvent or softener to remove the soil or stain from the surface. The oil component is provided in the single phase microemulsion in an amount ranging between about 1 wt. % and 50 wt. %.

Examples of the oil component include one or a mixture of the following: hydrocarbon and aromatic solvents such as hexadecane, hexane, dipentene, and octyl benzene; glycol ethers; mineral spirits; limonene; fatty alcohols such as decyl alcohol, lauryl alcohol, cetyl alcohol, stearyl alcohol and mixtures thereof; fatty acids such as lauric acid and myristic acid; carboxylic diester oils; motor oils; and natural or synthetic triglycerides oils.

Other examples of the oil component include one a mixture of t-butyl acetate, propylene carbonate, trichloroethylene, pine oil, benzyl alcohol, n-hexanol, phthalic acid esters of $C_{1-4}$ alcohols, butoxy propanol, and 1(2-n-butoxy-1-methylethoxy)propane-2-ol (also called butoxy propoxy propanol or dipropylene glycol monobutyl ether), hexyl diglycol, butyl triglycol, and diols such as 2,2,4-trimethyl-1,3-pentanediol.

Other components which may be included in the cleaning compositions to improve overall product performance include builders, dispersant polymers, thickeners, anti-tarnish and/or corrosion inhibitors, lubricants, brighteners and bleaches, antioxidizing agents, colors or dyes, fragrances, emollient oils (such as polyisobutylene, mineral oil, petrolatum and isocetyl stearyl stearate), pH adjusting agents, buffering agents, chelants, enzymes, enzyme stabilizing agents, suds stabilizers or suppressors, fabric softeners (such as a fabric softening smectite-type clay), antimicrobial agents, germicides, bactericides, mildew control agents, abrasives, carriers, processing aids, miscellaneous salts, and pigments. Levels of these other components may range from 0.00001% by weight to about 99.9% by weight of the cleaning composition.

Suitable builders can be selected from the group consisting of phosphates and polyphosphates, especially the sodium salts; carbonates, bicarbonates, sesquicarbonates and carbonate minerals other than sodium carbonate or sesquicarbonate; organic mono-, di-, tri-, and tetracarboxylates especially water-soluble nonsurfactant carboxylates in acid, sodium, potassium or alkanolammonium salt form, as well as oligomeric or water-soluble low molecular weight polymer carboxylates including aliphatic and aromatic types; and inorganic builders such as sulfates, citrate, zeolite, aluminosilicates, and phytic acid. These may be complemented by borates, e.g., for pH-buffering purposes, or by sulfates, especially sodium sulfate and any other fillers or carriers which may be important to the engineering of stable surfactant and/or builder-containing detergent compositions. Builder mixtures, sometimes termed "builder systems" can also be used and typically comprise two or more conventional builders, optionally complemented by chelants, pH-buffers or fillers, though these latter materials are generally accounted for separately when describing quantities of materials herein. When present, builders comprise from about 1 wt. % to about 90 wt. % of the total cleaning composition.

Dispersant polymers are useful for improved filming performance and generally include polymers which inhibit the deposition of calcium carbonate or magnesium silicate. Suitable dispersant polymers include compounds which are at least partially neutralized or alkali metal, ammonium or substituted ammonium salts of polycarboxylic acids. Other dispersant polymers include the copolymers of acrylamide and acrylate, polyethylene glycols, polypropylene glycols, and polyaspartate. When present, the dispersant polymers may be added to the cleaning composition in amounts ranging from about 0.5 wt. % to about 25 wt. % of the total cleaning composition.

For some applications it is particularly desirable that the cleaning composition also contain a cellulosic thickener. A preferred thickener is hydroxyethyl cellulose. Other suitable cellulosic thickeners include carboxy methyl cellulose, hydroxypropyl cellulose, xantham gums and derivatives, guar gums and derivatives, acrylic thickeners, urethane thickeners, cationic thickeners, such as polyacrylamide types, and clay thickeners, such as bentonite or attapulgites. The amount of thickener added to the cleaning composition may range from 0 wt. % to about 10 wt. % of the total cleaning composition.

Corrosion inhibitors and/or anti-tarnish aids, when present, are incorporated at low levels, for example, from about 0.01 wt. % to about 5 wt. % of the cleaning composition, and include compounds such as sodium metasilicate, alkali metal silicates, such as sodium or magnesium silicate, bismuth salts, manganese salts, paraffin oil, benzotriazoles, pyrazoles, thiols, mercaptans, aluminum fatty acid salts, and mixtures thereof.

Any optical brightener or brightening agent or bleach may used in the cleaning compositions of the present invention. Typically, brightening agents, when incorporated into the cleaning compositions, are at levels ranging from about 0.01 wt. % to about 1.2 wt. % of the total cleaning composition. The brightening agents may include derivatives of stilbene, pyrazoline, coumarin, carboxylic acid, methinecyanines, dibenzothiophene-5,5-dioxide, azoles, 5- and 6-membered-ring heterocycles, and other miscellaneous agents. In addition, peroxyacid, perborate, percarbonates and chlorine bleach may be used, generally at levels ranging from about 1 wt. % to about 30 wt. % of the total cleaning composition. The bleaches may also be used in conjunction with bleach activators, such as amides, imides, esters and anhydrides and/or bleach stabilizers.

Antioxidizing agents or preservatives optionally added to the cleaning composition include compounds such as formalin, 5-chloro-2-methyl-4-isothaliazolin-one, and 2,6-di-tert-butyl-p-cresol. Any other conventional antioxidant used in detergent compositions may also be included such as 2,6-di-tert-butyl-4-methylphenol (BHT), carbamate, ascorbate, thiosulfate, monoethanolamine(MEA), diethanolamine, and triethanolamine. When present, these components comprise from about 0.001 wt. % to about 5 wt. % of the total cleaning composition.

The cleaning compositions of the present invention may also include colors and/or fragrances. Such colors are well known to those skilled in the art of cleaning compositions and include Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), and Acid Green 25 (Ciba-Geigy). Examples of fragrances include natural products such as ambergris, benzoin, castoreum, civet, clove oil, galbanum, jasmine, rosemary oil, sandalwood, orange oil, lemon oil, rose extract, lavender, musk, pine oil, cedar and the like. Examples of aroma chemicals include, but are not limited to, isoamyl acetate (banana); isobutyl propionate (rum); methyl anthranilate (grape); benzyl acetate (peach); methyl butyrate (apple); ethyl butyrate (pineapple); octyl acetate (grange); n-propyl acetate (pear); and ethyl phenyl acetate (honey). The cleaning compositions according to the invention can contain any combination of the above types of compounds in an effective amount necessary to produce an odor masking effect or reduce an unwanted odor to an acceptable level. Such an amount will be readily determinable by those skilled in the art and can range from about 0.01 wt. % to about 2 wt. % of the cleaning composition.

Also, it may be desirable to include sodium hydroxide or ammonia in the form of ammonium hydroxide to raise the pH of the cleaning composition and enhance cleaning performance. Furthermore, sulfuric acid, lactic acid, sulfamic acid, glycolic acid, citric acid, acetic acid, formic acid or propionic acid may be included to enhance cleaning and lower the pH of the cleaning composition as needed.

Buffering agents which may be added to the cleaning composition for the purpose of maintaining pH include low molecular weight, organic or inorganic buffering materials generally used by those skilled in the art. When present, the buffering agent is generally at a level of about 0.1 wt. % to about 15 wt. % of the total cleaning composition. Some examples are amino acids such as lysine or lower alcohol amines like mono-, di-, and tri-ethanolamine. Other preferred buffering agents are Tri(hydroxymethyl)amino methane (HOCH2)3CNH3 (TRIS), 2-amino-2-ethyl-1,3-propanediol, 2-amino-2-methyl-propanol, 2-amino-2-methyl-1,3-propanol, disodium glutamate, N-methyl diethanolamide, 1,3-diamino-propanol N,N'-tetra-methyl-1,3-diamino-2-propanol, N,N-bis(2-hydroxyethyl)glycine (bicine) and N-tris (hydroxymethyl)methyl glycine (tricine). Mixtures of any of the above are also acceptable. Useful inorganic buffers include the alkali metal carbonates and alkali metal phosphates, e.g., sodium carbonate, sodium polyphosphate. Also suitable are organic acids like citric acid and acetic acid.

Chelants may also be included in the cleaning compositions from about 0.01 wt. % to about 15 wt. % of the total cleaning composition and are generally iron and/or manganese chelating agents. Examples of such chelating agents include: amino carboxylates such as ethylenediaminetetracetates and N-hydroxyethylethylenediaminetriacetates; amino phosphonates, for example, ethylenediaminetetrakis(methylenephosphonates); polyfunctionally-substituted aromatic chelating agents such as 1,2-dihydroxy-3,5-disulfobenzene; and any mixtures thereof.

If desired, enzymes may be included in the cleaning composition to provide cleaning performance benefits. The enzymes, when present, range from about 0.0001 wt. % to about 5 wt. % of active enzyme by weight of the total cleaning composition and include one or a mixture of cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, beta-glucanases, and arabinosidases.

When enzymes are present, enzyme stabilizers may also be included in the cleaning compositions in an amount ranging from about 0.001 wt. % to about 10 wt. % of total cleaning composition. Enzyme stabilizers are compounds that are compatible with the enzymes and include calcium ion, boric acid, propylene glycol, short chain carboxylic acids, boronic acids, and mixtures thereof. For example, boric acid salt, such as an alkali metal borate or amine (e.g. an alkanolamine) borate, or an alkali metal borate, or potassium borate, calcium chloride, calcium hydroxide, calcium formate, calcium malate, calcium maleate, calcium hydroxide and calcium acetate are enzyme stabilizers which may be used in the cleaning compositions of the present invention.

Polymeric suds stabilizers may be included to provide extended suds volume and duration and generally include homopolymers of (N,N-dialkylamino)alkyl acrylate esters, such as (N,N-dimethylamino)alkyl acrylate esters. When present, the polymeric suds stabilizers are incorporated into the cleaning compositions at levels ranging from about 0.01 wt. % to about 15 wt. % of the total cleaning composition.

Suds suppressors are compounds used for reducing the formation of suds and can also be incorporated into the cleaning compositions of the present invention at levels ranging from about 0.1 wt. % to about 10 wt. % of the total cleaning composition. One category of suds suppressors encompasses monocarboxylic fatty acids and salts therein having hydrocarbyl chains of 10-24 carbon atoms. Suitable salts include sodium, potassium and lithium salts and ammonium and alkanolammonium salts. Other suds suppressors include non-sufactant suds suppressors such as high molecular weight hydrocarbons (e.g. paraffin), fatty acid esters (e.g., fatty acid triglycerides), fatty acid esters of monovalent alcohols, aliphatic $C_{18}$-$C_{40}$ ketones (e.g., stearone) and polyorganosiloxane oils.

Antimicrobial agents which may be present in the cleaning composition include disinfectants such as benzalkonium chloride, polyhexamethylene biguanide, phenolic disinfectants, amphoteric disinfectants, anionic disinfectants, and metallic disinfectants (e.g. silver). Other antimicrobial agents include hydrogen peroxide, peracids, ozone, hypochloride and chlorine dioxide. The amount of antimicrobial agent which may be incorporated into the cleaning composition ranges from about 0.1 wt. % to about 10 wt. % of the total cleaning composition.

Germicides which may be included are compounds such as copper sulfate. If present, the germicide can range from between 0.01 wt. % to 5 wt. % of the total cleaning composition.

Formulating the Cleaning Composition

To make cleaning compositions of the invention, the components above are combined together by means well known in the art. The relative levels of the components are selected to give the required performance of the composition in a hard surface or soft surface cleaning application, with an eye toward making sure on the one hand that a component is present at a sufficient level to be effective, but on the other hand that excessive cost is avoided by limiting the upper range of the component.

Because the cleaning compositions are prepared as liquid formulations, and since no particular mixing is required to form the single phase microemulsion, the compositions may be easily prepared in any suitable vessel or container. The order of mixing the components is not particularly important and generally the various components can be added sequentially or all at once in the form of aqueous solutions.

Microemulsion formation from the above components proceeds spontaneously due to the favorable free energy of formation as the components are mixed together. Although microemulsions are thermodynamically favored, kinetic barriers may in some instances impede their formation. Accordingly, the application of moderate increases in mixing energy or temperature can be applied if necessary to overcome such kinetic barriers in the formation of the microemulsion.

In addition to the cleaning compositions described above (which are produced by mixing the desired components together to form a liquid), the cleaning compositions of the invention may also be formulated as a bar by using a binding agent to hold the bar together in a cohesive, soluble form. The binding agent may be natural or synthetic starch, gum, thickener, or any mixtures thereof. Furthermore, the cleaning composition may be formulated as a paste or gel by the addition of a thickening or gelling agent such as fumed silica, organic gums, polymers, paraffin wax, bentonite clay and cellulose ethers.

In another embodiment, the cleaning composition of the present invention is provided as a low to moderate bulk density powder. The low to moderate bulk density powder may be prepared by spray-drying a liquid slurry comprising a cleaning composition of the present invention and optionally dry-mixing further ingredients. In another embodiment, the low to moderate bulk density powder is concentrated or compacted by mixing and granulating the powder composition using a high-speed mixer/granulator, or other non-tower drying process. In yet another embodiment tablets may be prepared by compacting concentrated powders comprising the cleaning composition of the present invention.

Once formulated, the cleaning compositions of the present invention can be packaged in a variety of containers such as steel, tin, or aluminum cans, plastic or glass bottles and paper or cardboard containers.

In another form, the present invention provides a method of cleaning a hard surface or soft surface. A standard means of treatment is to apply a cleaning composition according to the present invention against a hard surface or soft surface in a variety of application means, for example, spraying, such as in aerosol form or by standard spray nozzles, rubbing, scraping, brush application, dipping, coating, application in gel form, or pouring the cleaning composition against the hard surface or soft surface. The hard or soft surface may then be rinsed with water and/or wiped until the cleaner is no longer visible to the eye. The hard or soft surface may also be air-dried to remove the cleaning composition or remaining water from the surface.

Use levels of the cleaning compositions can vary widely depending on the intended application, ranging, for example, from a few ppm in solution to a "direct application" of the neat cleaning composition to the hard or soft surface to be cleaned.

EXAMPLE 1

Preparation of an Extended Chain Surfactant

Pure-cut $C_{16}$ alcohol ($R_{16}$—OH) was reacted first with 10 moles of propylene oxide (PO) at a temperature of 120° C. using a base catalyst and then with 2 moles of ethylene oxide (EO) at a temperature of 160° C. The propylene oxide was allowed to digest completely and vacuum stripped prior to increasing the reaction temperature to minimize formation of allyic species and PPGs. The alkoxylated alcohol was then reacted with chlorosulfonic acid (CSA), vacuum stripped to remove HCl and neutralized with sodium hydroxide in water to give a 25-30% active aqueous solution.

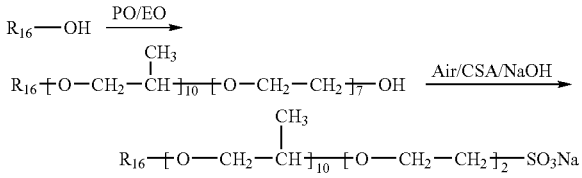

A second propylene oxide extended ether sulfate was prepared using a linear primary 12-14 carbon number alcohol. The $C_{12-14}$ alcohol ($R_{12-14}$—OH) was reacted with 12 moles of propylene oxide and 2 moles of ethylene oxide as above to produce a $C_{12-14}$ alkoxylated alcohol. The alkoxylated alcohol was then reacted with chlorosulfonic acid and neutralized with sodium hydroxide to give the following extended chain ether sulfate:

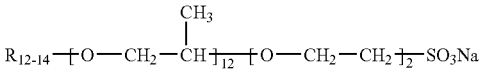

EXAMPLE 2

Solubilization Test

Single phase microemulsions of pine oil were prepared using the surfactant blends described below in Tables 1 and 2:

TABLE 1

| Ingredient | Blend 1C (wt %) | Blend 2C (wt %) | Blend 3C (wt %) | Blend 4C (wt %) | Blend 5C (wt %) | Blend 6C (wt %) |
|---|---|---|---|---|---|---|
| SXS-40* | 33.3 | 33.3 | 33.3 | 33.3 | 33.3 | 33.3 |
| SURFONIC ® L24-2** | 22.2 | 17.8 | 13.3 | 8.9 | 4.4 | 0 |
| SURFONIC ® L24-7*** | 0 | 4.4 | 8.9 | 13.3 | 17.8 | 22.2 |
| NaAES**** (25%) | 44.4 | 44.4 | 44.4 | 44.4 | 44.4 | 44.4 |
| Total | 100 | 100 | 100 | 100 | 100 | 100 |
| HLB | 8 | 8.78 | 9.56 | 10.34 | 11.12 | 11.9 |

*Sodium xylene sulfonate
**2-mole ethoxylate of linear primary 12-14 carbon number alcohol
***7-mole ethoxylate of linear primary 12-14 carbon number alcohol
****conventional 2-mole EO sulfate based on 12-14 carbon number alcohol

TABLE 2

| Ingredient | Blend 1 (wt %) | Blend 2 (wt %) | Blend 3 (wt %) | Blend 4 (wt %) | Blend 5 (wt %) | Blend 6 (wt %) |
|---|---|---|---|---|---|---|
| SXS-40* | 33.3 | 33.3 | 33.3 | 33.3 | 33.3 | 33.3 |
| SURFONIC ® L24-2** | 22.2 | 17.8 | 13.3 | 8.9 | 4.4 | 0 |
| SURFONIC ® L24-7*** | 0 | 4.4 | 8.9 | 13.3 | 17.8 | 22.2 |

TABLE 2-continued

| Ingredient | Blend 1 (wt %) | Blend 2 (wt %) | Blend 3 (wt %) | Blend 4 (wt %) | Blend 5 (wt %) | Blend 6 (wt %) |
|---|---|---|---|---|---|---|
| NaAES-12PO-2EO**** (25%) | 44.4 | 44.4 | 44.4 | 44.4 | 44.4 | 44.4 |
| Total | 100 | 100 | 100 | 100 | 100 | 100 |
| HLB | 8 | 8.78 | 9.56 | 10.34 | 11.12 | 11.9 |

*Sodium xylene sulfonate
**2-mole ethoxylate of linear primary 12-14 carbon number alcohol
***7-mole ethoxylate of linear primary 12-14 carbon number alcohol
**12-mole PO 2-mole EO extended chain ether sulfate based on linear 12-14 carbon number alcohol Solubilization efficiency for the surfactant blends was established by first titrating a 50/50 wt. % solution of pine oil and water until a single phase microemulsion was formed, then measuring the ratio of oil to surfactant at the phase boundary. The results are presented in FIG. 1**.

As shown in FIG. 1, at low HLB, the conventional and extended chain surfactants have similar solubilization efficiencies. However, at high HLB, the extended chain surfactant provides a 4-fold increase in solubilization efficiency.

Electrolyte Addition

Additional single phase microemulsions of pine oil were prepared using the surfactant blends described below in Tables 3-6:

TABLE 3

| Ingredient | Blend 7C (wt %) |
|---|---|
| SXS-40 | 33.3 |
| $C_{10-12}$ + 8EO | 22.2 |
| NaAES* (20%) | 44.5 |

*conventional 2-mole EO sulfate based on 12-14 carbon number alcohol

TABLE 4

| Ingredient | Blend 8 (wt %) | Blend 9 (wt %) | Blend 10 (wt %) |
|---|---|---|---|
| SXS-40 | 33.3 | 33.3 | 33.3 |
| $C_{10-12}$ + 8EO | 22.2 | 22.2 | 22.2 |
| NaAES-10PO-2EO* (20%) | 44.5 | | |
| NaAES-14PO-2EO** (20%) | | 44.5 | |
| NaAES-18PO-2EO*** (20%) | | | 44.5 |

*10-mole PO 2-mole EO extended chain ether sulfate based on a linear 10 carbon number alcohol
**14-mole PO 2-mole EO extended chain ether sulfate based on linear 10 carbon number alcohol
***18-mole PO 2-mole EO extended chain ether sulfate based on linear 10 carbon number alcohol

TABLE 5

| Ingredient | Blend 11 (wt %) | Blend 12 (wt %) | Blend 13 (wt %) |
|---|---|---|---|
| SXS-40 | 33.3 | 33.3 | 33.3 |
| $C_{10-12}$ + 8EO | 22.2 | 22.2 | 22.2 |
| NaAES-10PO-2EO* (20%) | 44.5 | | |
| NaAES-16PO-2EO** (20%) | | 44.5 | |
| NaAES-18PO-2EO*** (20%) | | | 44.5 |

*10-mole PO 2-mole EO extended chain ether sulfate based on a linear 12 carbon number alcohol
**16-mole PO 2-mole EO extended chain ether sulfate based on linear 12 carbon number alcohol
***18-mole PO 2-mole EO extended chain ether sulfate based on linear 12 carbon number alcohol

TABLE 6

| Ingredient | Blend 14 (wt %) | Blend 15 (wt %) | Blend 16 (wt %) |
|---|---|---|---|
| SXS-40 | 33.3 | 33.3 | 33.3 |
| $C_{10-12}$ + 8EO | 22.2 | 22.2 | 22.2 |
| NaAES-10PO-2EO* (20%) | 44.5 | | |
| NaAES-14PO-2EO** (20%) | | 44.5 | |
| NaAES-18PO-2EO*** (20%) | | | 44.5 |

*10-mole PO 2-mole EO extended chain ether sulfate based on a linear 16 carbon number alcohol
**14-mole PO 2-mole EO extended chain ether sulfate based on linear 16 carbon number alcohol
***18-mole PO 2-mole EO extended chain ether sulfate based on linear 16 carbon number alcohol Solubilization efficiency for the surfactant blends was established by titrating a 50/50 wt. % solution of pine oil and water until a single phase microemulsion was formed, then measuring the ratio of oil to surfactant at the phase boundary. Various amounts of NaCl were then added to the 50/50 wt. % solution of pine oil and water and this solution was titrated with various amounts of the surfactant blends (see Table 7) until a single phase microemulsion was formed. The amount of surfactant blend and oil were then measured at the phase boundary and the results presented in Table 8.

TABLE 7

| | Amt. Sufactant Blend | | | | | | | | | |
|---|---|---|---|---|---|---|---|---|---|---|
| Amt. NaCl (g) | Blend 7C (g) | Blend 8 (g) | Blend 9 (g) | Blend 10 (g) | Blend 11 (g) | Blend 12 (g) | Blend 13 (g) | Blend 14 (g) | Blend 15 (g) | Blend 16 (g) |
| 0 | 141.4 | 142.3 | 131.9 | 112.1 | 117.4 | 114.4 | 108.3 | 119.7 | 140.2 | 129.1 |
| 2 | 113.7 | 165.7 | 119.5 | 111 | 95.7 | 103.4 | 99 | 105.2 | 117.6 | 108.6 |
| 4 | 101.8 | | 102.3 | 72.6 | 86.5 | 92.6 | 90.4 | 89.8 | 101.5 | 79 |
| 6 | 86.1 | 141.9 | 87.3 | 64.2 | 71 | 68 | 88.1 | 72.6 | 78.7 | 62.8 |
| 8 | 70.1 | | 49.6 | 50.1 | 50.1 | 44.4 | 34.5 | 29.8 | 28.6 | 27.5 |
| 10 | 53 | 142 | 35.8 | 40.8 | 36.9 | 24.7 | 28.3 | 26.8 | 26.9 | 21.7 |

TABLE 8

| Amt. | Ratio Oil/Surfactant Blend | | | | | | | | | |
|---|---|---|---|---|---|---|---|---|---|---|
| NaCl (g) | Blend 7C | Blend 8 | Blend 9 | Blend 10 | Blend 11 | Blend 12 | Blend 13 | Blend 14 | Blend 15 | Blend 16 |
| 0 | 0.24 | 0.23 | 0.25 | 0.30 | 0.28 | 0.29 | 0.31 | 0.28 | 0.24 | 0.26 |
| 2 | 0.29 | 0.20 | 0.28 | 0.30 | 0.35 | 0.32 | 0.34 | 0.32 | 0.28 | 0.31 |
| 4 | 0.33 | | 0.33 | 0.46 | 0.39 | 0.36 | 0.37 | 0.37 | 0.33 | 0.42 |
| 6 | 0.39 | 0.24 | 0.38 | 0.52 | 0.47 | 0.49 | 0.38 | 0.46 | 0.42 | 0.53 |
| 8 | 0.48 | | 0.67 | 0.67 | 0.67 | 0.75 | 0.97 | 1.12 | 1.17 | 1.21 |
| 10 | 0.63 | 0.24 | 0.93 | 0.82 | 0.91 | 1.35 | 1.18 | 1.24 | 1.24 | 1.54 |

Figure 2:
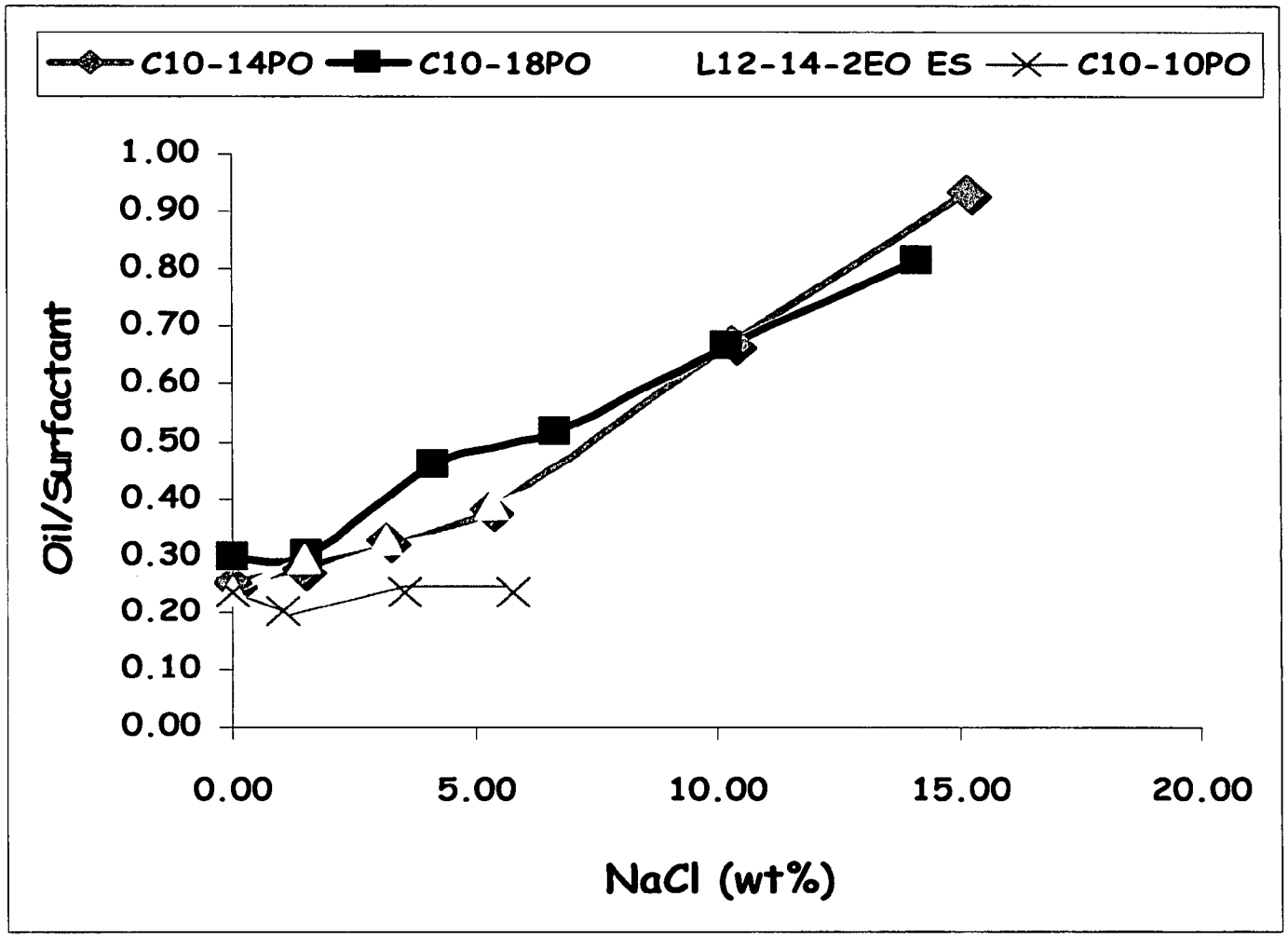
FIGS. 2-4 are graphs describing the ratio of the amounts of oil and surfactant blend at the phase boundary of a single phase microemulsion formed using a conventional ether sulfate or an extended chain ether sulfate and a 50/50 wt. % solution of pine oil and water with various amounts of NaCl added to the 50/50 wt. % solution with NaCl being expressed as wt. % based on the total weight of surfactant blend.
Figure 3:
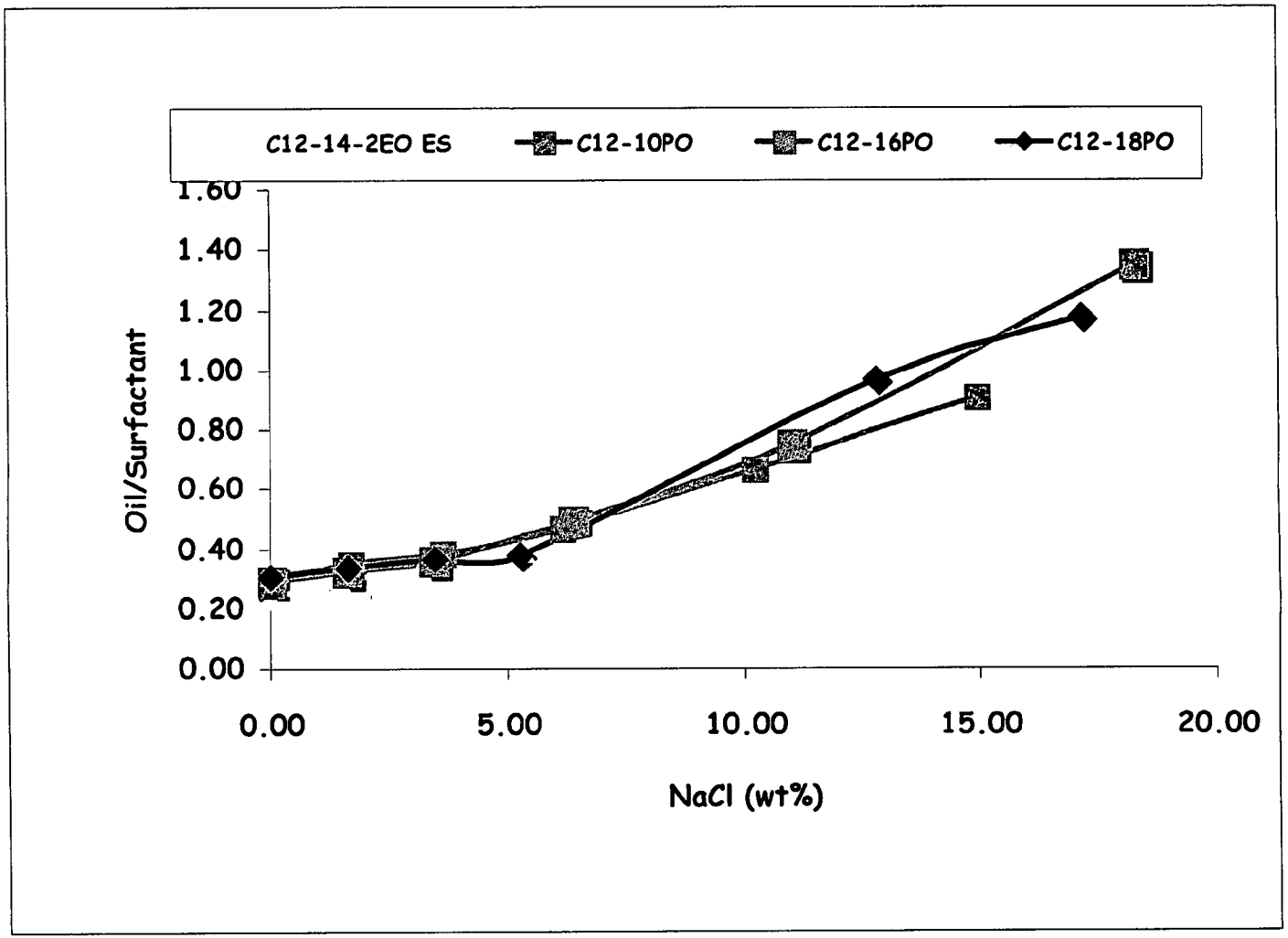
Figure 4:
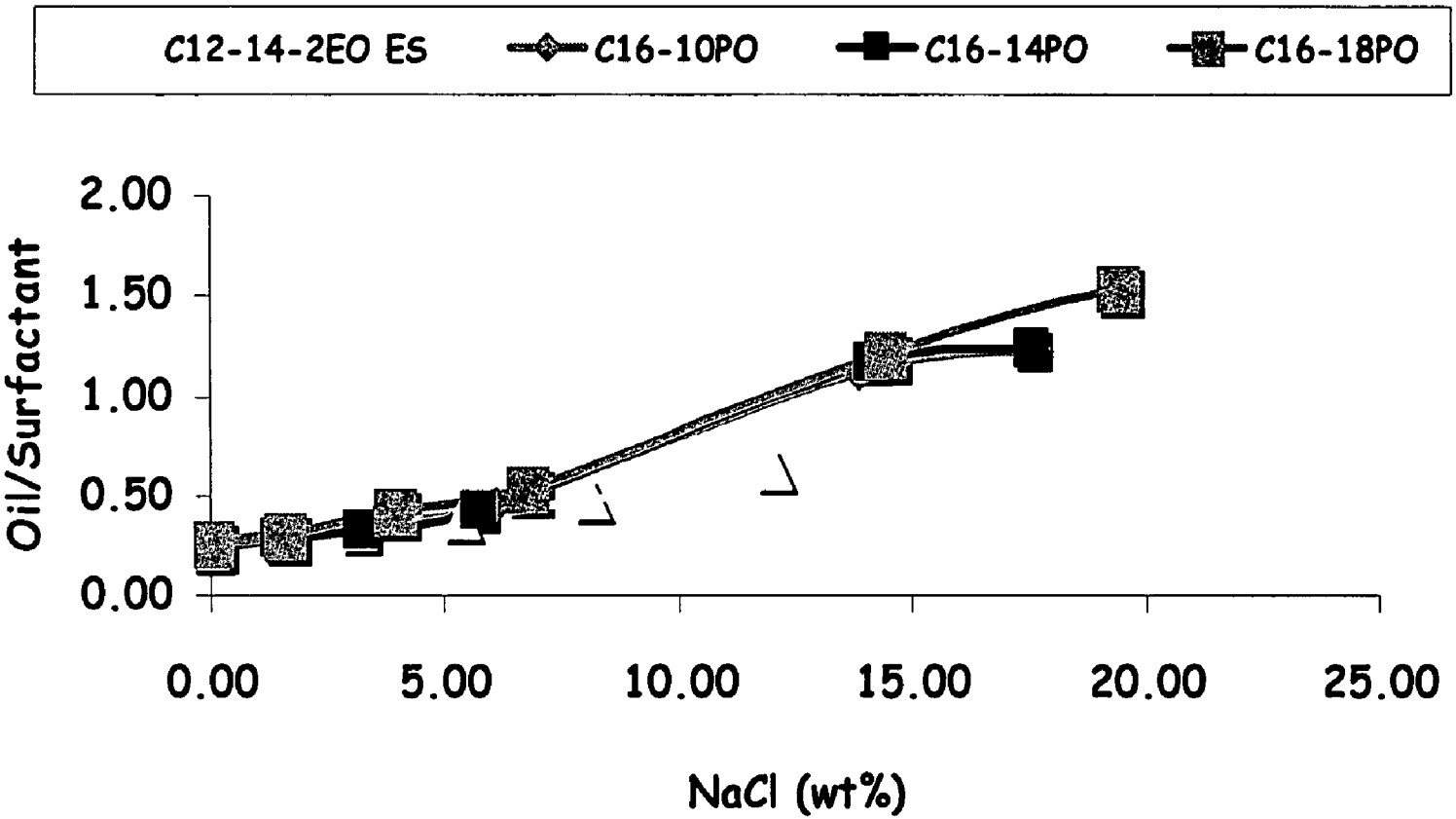
Figure 5:
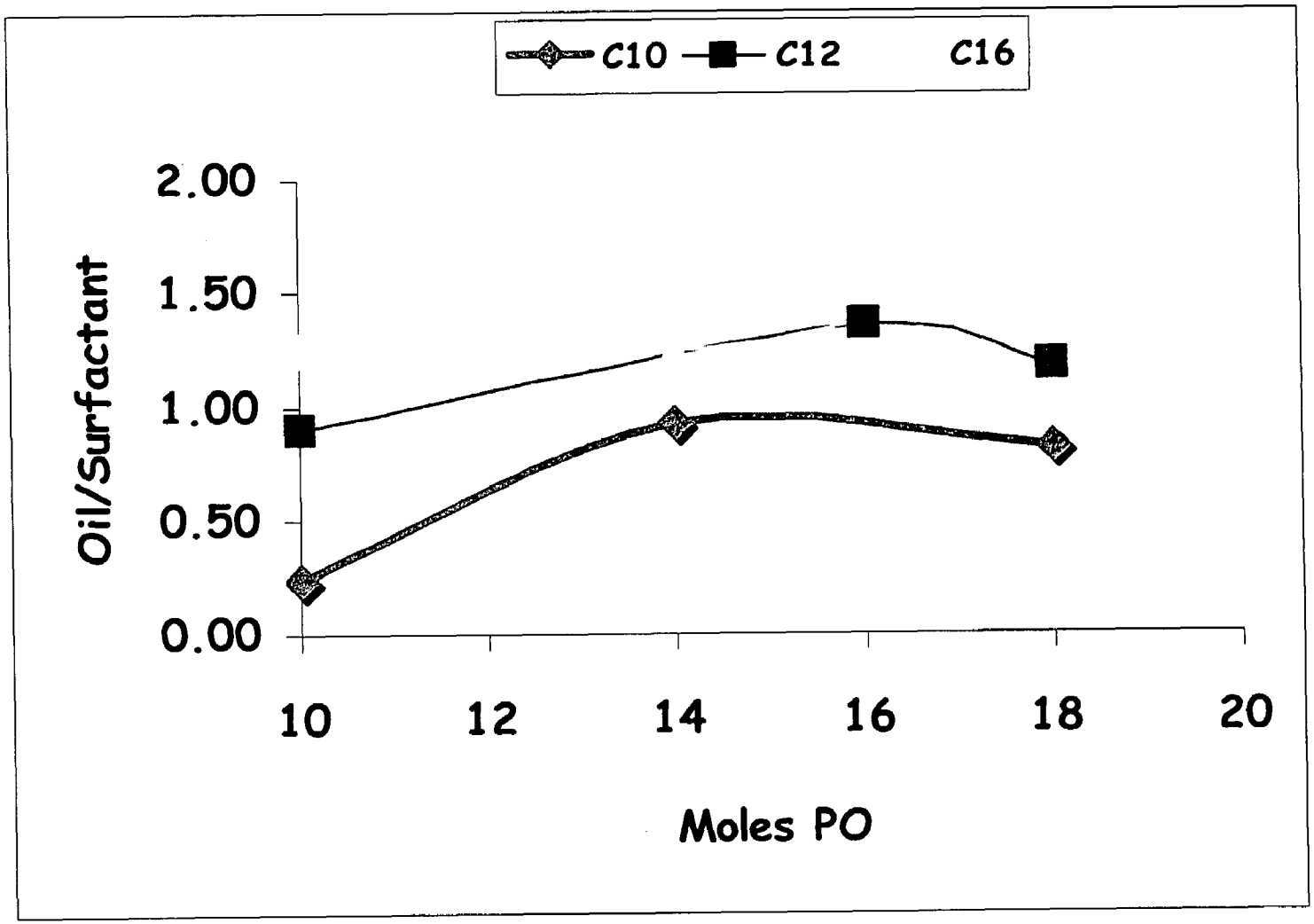
FIGS. 5 and 6 are graphs describing the ratio of the amounts of oil and surfactant blend at the phase boundary of a single phase microemulsion formed using an extended chain ether sulfate and a 50/50 wt. % solution of pine oil and water with various amounts of NaCl added to the 50/50 wt. % solution as a function of the number of moles of propylene oxide and chain length of the extended chain ether sulfate.
Figure 6:
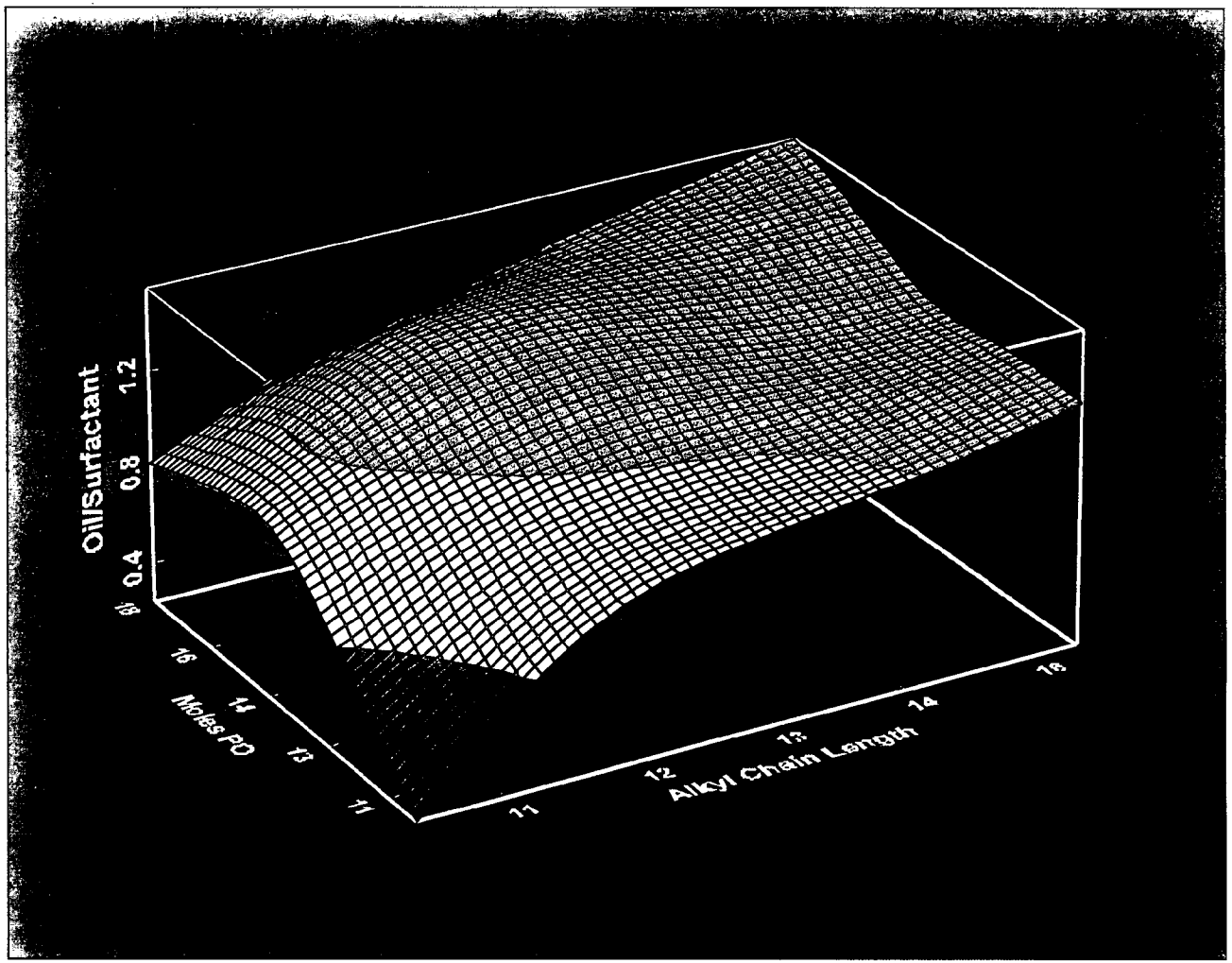
Figure 7:
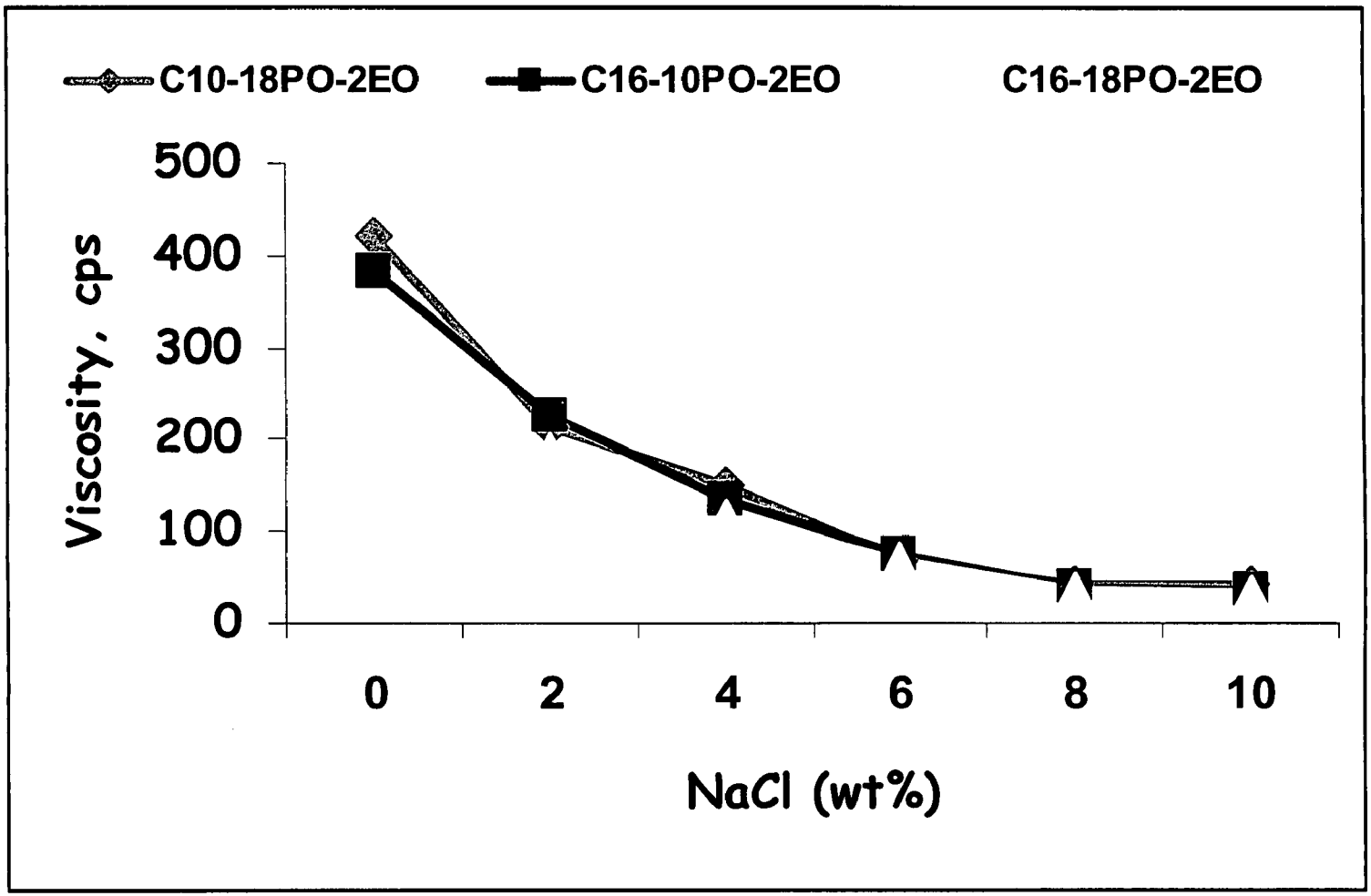
FIG. 7 is a graph describing the change in viscosity of a single phase microemulsion formed from a surfactant blend according to the present invention and a 50/50 wt. % solution of pine oil and water as increasing amounts of NaCl are added to the microemulsion with NaCl being expressed as wt. % based on the total amount of surfactant blend.

As shown in FIGS. 2-4, as the amount of NaCl that is added to the 50/50 wt. % pine oil and water solution increases, the ratio of oil/surfactant blend at the phase boundary increases indicating that less surfactant blend is required to form the single phase microemulsion. FIGS. 5 and 6 further illustrate the results above with regards to the number of moles of PO and the linear alkyl chain length of the extended chain surfactant. Finally, Table 9 and FIG. 7 illustrate the decrease in the viscosity of the microemulsion as the amount of NaCl that is added to the microemulsion is increased.

TABLE 9

| Amt. NaCl Added (wt. %) | Blend 10 (cps) | Blend 14 (cps) | Blend 16 (cps) |
|---|---|---|---|
| 0 | 420 | 384 | 287 |
| 2 | 214 | 227 | 190 |
| 4 | 151 | 134 | 116 |
| 6 | 71 | 75 | 70 |
| 8 | 43 | 42 | 38 |
| 10 | 45 | 37 | 35 |

EXAMPLE 3 (PROPHETIC)

Hard Surface Cleaner

The following cleaning composition may be prepared by mixing the following listed components and then used as a hard surface cleaner:

| Component | Wt. % | Range Wt. % |
|---|---|---|
| Surfactant Blend | 3 | 1-10 |
| $C_{23}$ branched primary alcohol condensed with an ave. of 3 moles of EO | 1 | 1-10 |
| $C_{24}$ branched primary alcohol condensed with an ave. of 21 moles of EO | 2 | 1-10 |
| Sodium paraffin sulfonate | 2 | 0.5-5 |
| Sodium toluene sulfonic acid | 2 | 0.5-5 |
| Magnesium sulfate | 1 | 0.5-3 |
| Trisodium citrate | 3 | 0.5-6 |
| Sodium bicarbonate | 0.1 | 0-0.5 |
| Sodium phosphate (dibasic) | 0.1 | 0-0.5 |
| Disodium pyrophosphate | 0.1 | 0-0.5 |
| Water and minors | q.s. to 100% | q.s. to 100% |

EXAMPLE 4 (PROPHETIC)

Granular Laundry Detergent

The following laundry detergent may be prepared in accord with the invention:

| Component | Wt. % | Range Wt. % |
|---|---|---|
| Surfactant Blend | 7 | 1-10 |
| Sodium $C_{14-15}$ linear alkyl sulfate | 10 | 1-15 |
| Soap | 2 | 0.5-5 |
| Alkoxylated quaternary ammonium surfactant* | 0.5 | 0.1-5 |
| Zeolite A | 20 | 15-30 |
| Acrylic/maleic copolymer | 1 | 0-5 |

-continued

| Component | Wt. % | Range Wt. % |
|---|---|---|
| Sodium carbonate | 15 | 10-30 |
| Sodium silicate | 0.5 | 0-3 |
| Sodium perborate bleach | 1 | 0-3 |
| Protease | 0.25 | 0-0.5 |
| Amylase | 0.5 | 0-1 |
| Cellulase | 0.3 | 0-0.5 |
| Brightener** | 0.2 | 0-0.3 |
| Perfume | 0.1 | 0-1 |
| Sodium sulfate | 10 | 0-15 |
| Silicone Antifoam*** | 1 | 0-2 |
| Moisture and minors | Balance to 100% | Balance to 100% |

*$R_2N^+(CH_3)_x((C_2H_4O)_y)_z$ where R is $C_{8-18}$; x + z = 3 and x is 0-3, z is 0-3; and y is 1-15

**Disodium 4,4'-bis(4-anilino-6-morpholino-1.3.5-triazin-2-yl)amino)stilbene-2:2'-disulfonate

***10:1 to 100:1 Polydimethylsiloxane foam controller to siloxane-oxyalkylene copolymer

EXAMPLE 5 (PROPHETIC)

Liquid Laundry Detergent

The following liquid laundry detergent may be prepared in accord with the invention:

| Component | Wt. % | Range Wt. % |
|---|---|---|
| Surfactant Blend | 15 | 1-30 |
| Soap | 5 | 1-20 |
| Sodium tripolyphosphate | 20 | 1-25 |
| Sodium carboxymethyl cellulose | 0.5 | 0-4 |
| Sodium silicate | 8 | 1-10 |
| Sodium sulfate | 20 | 1-25 |
| Maleic-acrylic copolymer | 1 | 0-5 |
| Sodium carbonate | 10 | 1-20 |
| Tetracetyl ethylenediamine | 2 | 0-5 |
| Enzyme granules | 1 | 0-3 |
| Sodium perborate | 12 | 1-20 |
| Soil release polymer | 0.5 | 0-2 |
| Perfume | 0.3 | 0-1 |
| Water and misc. salts | q.s. to 100% | q.s. to 100% |

EXAMPLE 6 (PROPHETIC)

Hand Dishwashing Liquid Cleaner

The following hand dishwashing liquid cleaner may be prepared in accord with the invention:

| Component | Wt. % | Range Wt. % |
|---|---|---|
| Surfactant Blend | 5 | 1-20 |
| Mid-chain branched primary $C_{15}$ ethoxylate (ave EO = 2) sulfate, sodium salt | 2 | 0.5-10 |
| Ammonium $C_{12-13}$ alkyl sulfate | 7 | 1-35 |
| $C_{12-14}$ ethoxy (1) sulfate | 20 | 1-35 |
| Coconut amine oxide | 2.5 | 1-5 |
| Betaine | 0.5 | 0-2 |
| Ammonium xylene sulfonate | 4 | 1-6 |
| Ethanol | 3 | 0-7 |
| Ammonium citrate | 0.1 | 0-1 |

-continued

| Component | Wt. % | Range Wt. % |
|---|---|---|
| Magnesium chloride | 3 | 0-4 |
| Calcium chloride | 2.5 | 0-4 |
| Ammonium sulfate | 0.05 | 0-4 |
| Perfume | 0.1 | 0-0.5 |
| Water and minors | q.s. to 100% | q.s. to 100% |

Although making and using various embodiments of the present invention have been described in detail above, it should be appreciated that the present invention provides many applicable inventive concepts that can be embodied in a wide variety of specific contexts. The specific embodiments discussed herein are merely illustrative of specific ways to make and use the invention, and do not delimit the scope of the invention.

What is claimed is:

1. A surfactant blend comprising an extended chain surfactant and a high HLB nonionic surfactant wherein the extended chain surfactant comprises a compound of formula (I):

$$R\text{-}[L]_x\text{-}[O\text{—}CH_2]_y\text{—}O\text{—}SO_3A \quad (I)$$

where R is a linear or branched, saturated or unsaturated, substituted or unsubstituted, aliphatic or aromatic hydrocarbon radical having from 12 to 20 carbon atoms, L is an oxyalkylene linking group selected from the group consisting of a block of poly-propylene oxide, a block of poly-butylene oxide, and mixtures thereof, A is a cationic species present for charge neutrality selected from the group of hydrogen, an alkali metal, alkaline earth metal and animonium which may be substituted with one or more organic groups, x is the average degree of alkoxylation of the linking group ranging from 12 to 18, and y is the average degree of ethoxylation ranging from 1 to 5, the average degree of total alkoxylation ranging from 14 to 20 moles, and wherein the high HLB nonionic surfactant is not an ethoxylated nonylphenol, an ethoxylated dinonylphenol, an ethoxylated dodecylphenol, an ethoxylated dodecyl alcohol or a sorbitan lauryl ester ethoxylated with 20 EO groups.

2. The surfactant blend of claim 1 wherein the high HLB nonionic surfactant has an HLB of between about 10 to about 14.

3. A surfactant blend comprising an extended chain surfactant and a high HLB nonionic surfactant wherein the extended chain surfactant comprises a compound of formula (II):

$$R\text{—}(O\text{—}CH_2\text{—}CH(CH_3))_x\text{—}(O\text{—}CH_2\text{—}CH_2)_y\text{—}O\text{—}SO_3Na \quad (II)$$

where R is a linear or branched, saturated or unsaturated, substituted or unsubstituted aliphatic hydrocarbon radical having from about 12 to about 20 carbon atoms, x is the average degree of propoxylation ranging from 12-18, and y is the average degree of ethoxylation ranging from 1-5, the average degree of alkoxylation ranging from 14 to 20 moles, and wherein the high HLB nonionic surfactant is not an ethoxylated nonyiphenol, an ethoxylated dinonyiphenol, an ethoxylated dodecyiphenol, an ethoxylated dodecyl alcohol or a sorbitan lauryl ester ethoxylated with 20 EO groups.

4. The surfactant blend of claim 3 wherein the high HLB nonionic surfactant has an HLB of between about 10-14.

5. A cleaning composition comprising a surfactant blend according to claim 1.

6. A cleaning composition comprising a surfactant blend according to claim 3.

7. A cleaning composition comprising a surfactant blend according to claim 1 and an oil component.

8. A cleaning composition comprising a surfactant blend according to claim 3 and an oil component.

9. An article comprising a cleaning composition according to claim 5 and a container.

10. An article comprising a cleaning composition according to claim 6 and a container.

11. A method for removing a soil from a hard surface comprising applying a cleaning composition containing the surfactant blend according to claim 1 to the hard surface and rinsing and/or wiping the cleaning composition from the hard surface.

12. A method for removing a soil from a soft surface comprising applying a cleaning composition containing the surfactant blend according to claim 3 to the soft surface and rinsing and/or wiping the cleaning composition from the soft surface.

13. The surfactant blend of claim 1 wherein the oxyalkylene linking group, L, further includes one or more blocks of poly-ethylene oxide.

14. The surfactant blend of claim 3 wherein R is a linear aliphatic hydrocarbon radical having from about 12 to about 20 carbon atoms.

15. The surfactant blend of claim 3 wherein said surfactant blend forms a single-phase microemulsion.

* * * * *